US010492009B2

(12) United States Patent
Sacha

(10) Patent No.: US 10,492,009 B2
(45) Date of Patent: Nov. 26, 2019

(54) HEARING AID WITH DISTRIBUTED PROCESSING IN EAR PIECE

(71) Applicant: Starkey Laboratories, Inc., Eden Prairie, MN (US)

(72) Inventor: Michael Karl Sacha, Chanhassen, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 20 days.

(21) Appl. No.: 13/889,212

(22) Filed: May 7, 2013

(65) Prior Publication Data

US 2013/0329926 A1 Dec. 12, 2013

Related U.S. Application Data

(60) Provisional application No. 61/643,901, filed on May 7, 2012.

(51) Int. Cl.
*H04R 25/00* (2006.01)

(52) U.S. Cl.
CPC ..... *H04R 25/55* (2013.01); *H04R 25/43* (2013.01)

(58) Field of Classification Search
CPC ..... H04R 25/554; H04R 25/558; H04R 2225/51; H04R 25/43; H04R 2225/31; H04R 2460/03; H04R 25/305; H04R 25/50; H04R 2225/61; H04R 2460/17; H04R 25/55; H04R 25/556; H04R 25/604; H04R 25/70; H04R 1/1016; H04R 1/1025; H04R 1/01
USPC ..... 381/312, 323, 324, 325, 328, 330; 181/135
See application file for complete search history.

(56) References Cited

U.S. PATENT DOCUMENTS

| | | | | |
|---|---|---|---|---|
| 4,870,689 | A * | 9/1989 | Weiss | 381/325 |
| 5,721,783 | A | 2/1998 | Anderson | |
| 5,929,636 | A * | 7/1999 | Torok et al. | 324/252 |
| 6,054,780 | A * | 4/2000 | Haigh et al. | 307/91 |
| 8,103,039 | B2 * | 1/2012 | van Halteren et al. | 381/355 |
| 8,687,832 | B2 * | 4/2014 | Elmedyb | H04R 25/453 381/312 |
| 2003/0200820 | A1 * | 10/2003 | Takada et al. | 73/862.626 |

(Continued)

FOREIGN PATENT DOCUMENTS

| | | |
|---|---|---|
| DE | 102007039452 B3 | 6/2009 |
| DE | 102008030551 A1 | 8/2009 |

OTHER PUBLICATIONS

"European Application Serial No. 13166826.1, Extended European Search Report dated May 2, 2014", 7 pgs.

*Primary Examiner* — Phylesha Dabney
(74) *Attorney, Agent, or Firm* — Schwegman Lundberg & Woessner, P.A.

(57) ABSTRACT

Disclosed herein, among other things, are methods and apparatus for hearing assistance devices, and in particular to behind the ear and receiver in canal hearing aids with distributed processing. One aspect of the present subject matter relates to a hearing assistance device including hearing assistance electronics in a housing configured to be worn above or behind an ear of a wearer. The hearing assistance device includes an ear piece configured to be worn in the ear of the wearer and a processing component at the ear piece configured to perform functions in the ear piece and to communicate with the hearing assistance electronics, in various embodiments.

19 Claims, 6 Drawing Sheets

(56) References Cited

U.S. PATENT DOCUMENTS

| | | | | |
|---|---|---|---|---|
| 2005/0244020 | A1* | 11/2005 | Nakajima | G10L 15/24 381/151 |
| 2007/0036377 | A1 | 2/2007 | Stirnemann | |
| 2008/0137873 | A1* | 6/2008 | Goldstein | H04R 1/1016 381/57 |
| 2009/0052706 | A1 | 2/2009 | Gottschalk et al. | |
| 2009/0074216 | A1* | 3/2009 | Bradford | H04R 25/554 381/315 |
| 2009/0164141 | A1* | 6/2009 | Lee | G01N 33/4972 702/30 |
| 2010/0124346 | A1 | 5/2010 | Higgins | |
| 2010/0158293 | A1 | 6/2010 | Polinske et al. | |
| 2010/0290637 | A1* | 11/2010 | Lerner | 381/74 |
| 2013/0329926 | A1* | 12/2013 | Sacha | 381/330 |
| 2014/0052801 | A1* | 2/2014 | Zuo | H04L 51/04 709/206 |

* cited by examiner

HEARING AID WITH DISTRIBUTED PROCESSING IN EAR PIECE

CLAIM OF PRIORITY AND INCORPORATION BY REFERENCE

The present application claims the benefit under 35 U.S.C. § 119(e) of U.S. Provisional Patent Application 61/643,901, filed May 7, 2012, the disclosure of which is hereby incorporated by reference herein in its entirety.

FIELD OF THE INVENTION

The present subject matter relates generally to hearing assistance devices, and in particular to behind the ear and receiver in canal hearing aids with distributed processing.

BACKGROUND

Modern hearing assistance devices, such as hearing aids, typically include digital electronics to enhance the wearer's listening experience. Hearing aids are electronic instruments worn in or around the ear that compensate for hearing losses by specially amplifying sound. Hearing aids use transducers (such as microphones and receivers) and electro-mechanical components which are connected via wires to the hearing aid circuitry. In addition to transducers, modern hearing assistance devices incorporate A/D converters, DAC's, signal processors, memory for processing the audio signals, and wireless communication systems.

Behind-the-ear (BTE) and receiver-in-canal hearing aids (also called RIC or RITE hearing aids) typically have included a processing portion that resides above or behind the ear with a microphone. The processing portion provides signals to the ear canal using a sound generator and tube (BTE) or to a receiver in the ear canal via wires that provide sound to the receiver in the ear canal (RIC or RITE). Changing the current distribution of components can be complicated by challenges associated with the number of lines and electromagnetic considerations, such as noise and cross talk.

What is needed in the art is an improved approach to provide more options for component placement in hearing aids.

SUMMARY

Disclosed herein, among other things, are methods and apparatus for hearing assistance devices, and in particular to behind the ear and receiver in canal hearing aids with distributed processing.

One aspect of the present subject matter relates to a hearing assistance device including hearing assistance electronics in a housing configured to be worn above or behind an ear of a wearer. The hearing assistance device includes an ear piece configured to be worn in the ear of the wearer and a processing component at the ear piece configured to perform functions in the ear piece and to communicate with the hearing assistance electronics using a wired connection, in various embodiments.

One aspect of the present subject matter relates to a hearing assistance method including providing a processing component at the ear piece portion of a hearing aid to perform functions in the ear piece and to communicate using a wired connection with hearing assistance electronics in a housing configured to be worn above or behind the ear.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

Disclosed herein, among other things, are methods and apparatus for placement of components in a hearing aid. Among other things, the present subject matter is helpful for issues arising with new configurations, such as providing options for interconnect lines and treating noise issues that can occur with new configurations. Using the present subject matter it is possible to provide different or additional functionality to at least a BTE or RIC ear piece. Other hearing aid applications and configuration approaches are possible without departing from the scope of the present subject matter.

Figure 1:
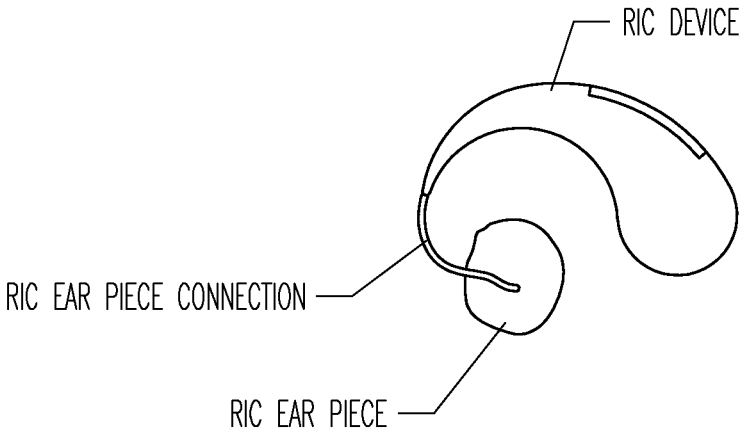
FIG. 1 illustrates a receiver-in-canal (RIC) hearing assistance device.

This application discusses the application of the present subject matter to RIC devices (see FIG. 1), but is not so limited and also extends to other devices, including, but not limited to BTE devices.

Figure 2:
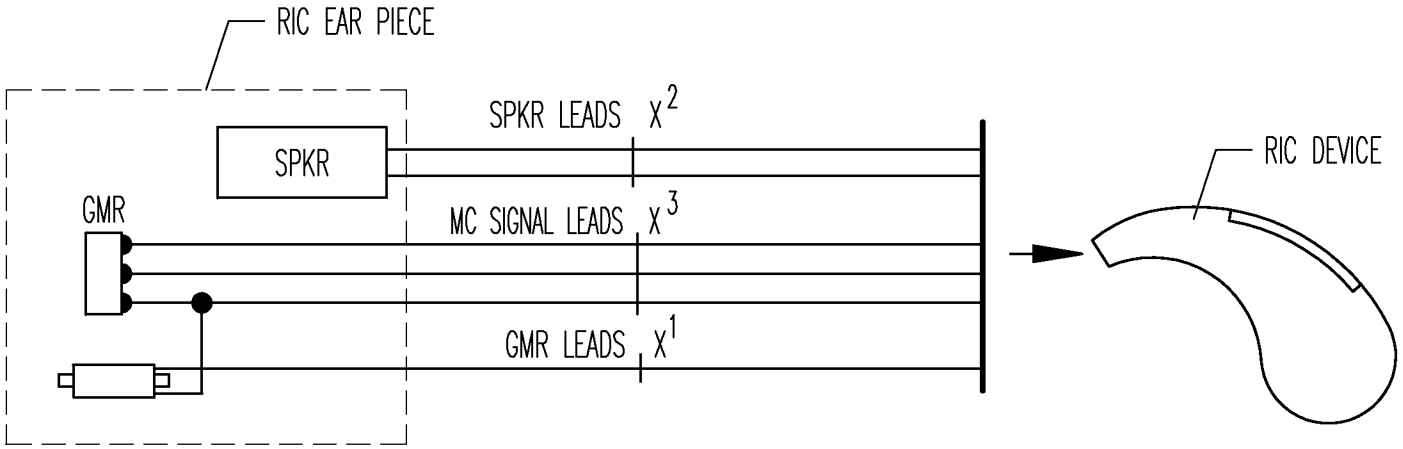
FIG. 2 illustrates the RIC hearing assistance device of FIG. 1 including a circuit diagram of an ear piece module.

To add more functionality to ear pieces and hearing aids in general, the interconnection between the main hearing aid body and the canal ear piece can become complicated and physically large and inflexible. The present subject matter presents an improved approach for controlling or reducing the number of interconnect lines and adding additional functionality without increasing the wire count. In one approach, as shown in FIG. 2, an interconnect cable contains 6 (six) conductors. A shield is included as one of the six. One example cable and component arrangement is illustrated by FIG. 2. With the three illustrated components all six conductors are used. It would be difficult to add additional components without changing the number of conductors and/or their configuration.

In FIG. 2, the ear piece (a RIC ear piece is used as one example) includes multiple components, such as a speaker (also known as a receiver), a magnetic field sensor (FIG. 2 demonstrates a GMR (giant magnetoresistive) sensor, however, in various embodiments other magnetic field sensors may be used), and a coil for inductive sensing (see the coil connected to the GMR). To add components, such as a microphone, additional conductors would need to be added to accommodate the additional components The present subject matter overcomes these difficulties by adding a processing component in the ear piece. For example, the processing component could be a microcontroller, a microprocessor, a digital signal processor, a custom chip design, combinational logic, or a combination of the foregoing.

Figure 4:
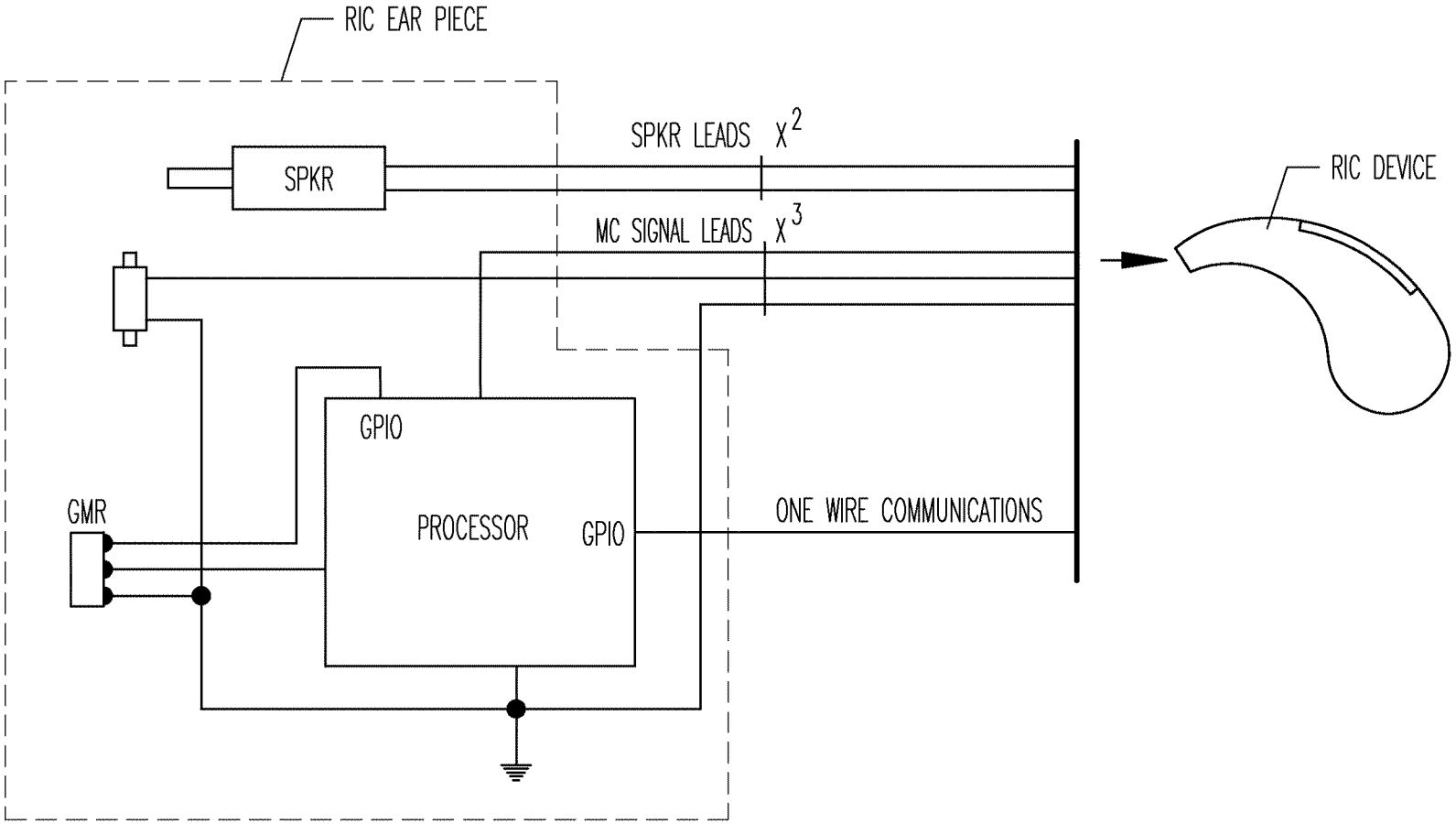
FIG. 4 illustrates a RIC hearing assistance device including a processor at the ear piece, according to various embodiments of the present subject matter.

By adding a processing component to the ear piece, the potential functional capability of the ear piece is increases greatly. One exemplary approach is the "one-wire" communications protocol. FIG. 4 demonstrates one example of a system using a processing component and a one wire communications approach to signaling with the electronics that resides over or behind the ear. The processor can perform functions in the ear piece and coordinate with the rest of the electronics. The wire count is reduced because the one wire approach allows for a multitude of signal and control options. In this embodiment, separate leads are shown for speaker and microphone signals, however, it is understood that these configurations can change as well, given the vast number of programmable options afforded by the implementation of the processing component. In the configuration of FIG. 4 a GMR and telecoil are connected to the processing component for control and signal transfer; however, it is understood that other configurations within the scope of the present subject matter are possible and the present teachings are not so limited.

The present subject matter provides additional benefits even in the case where the components in the ear piece are limited to a specific set. For example, the illustrated components (speaker, tele-coil and GMR) can be used with a processing component in the ear piece to provide, among other things, one or more of: ear piece identification, GMR switching, and/or component activation and deactivation for power conservation, to name only a few applications.

More functionality can be added to the ear piece using the processing component. For example, in FIG. 3, the added components of a microphone, a valve for controlling sound passage, and a capacitive switch are more readily performed using a processing component for managing the signals over the one wire communications. This allows for rapid deployment of several unique capabilities to products without requiring a new cable assembly between the earpiece and the electronics. The present system allows for reprogramming of the processing component for a variety of applications and for supporting a number of different components and communications.

Figure 3:
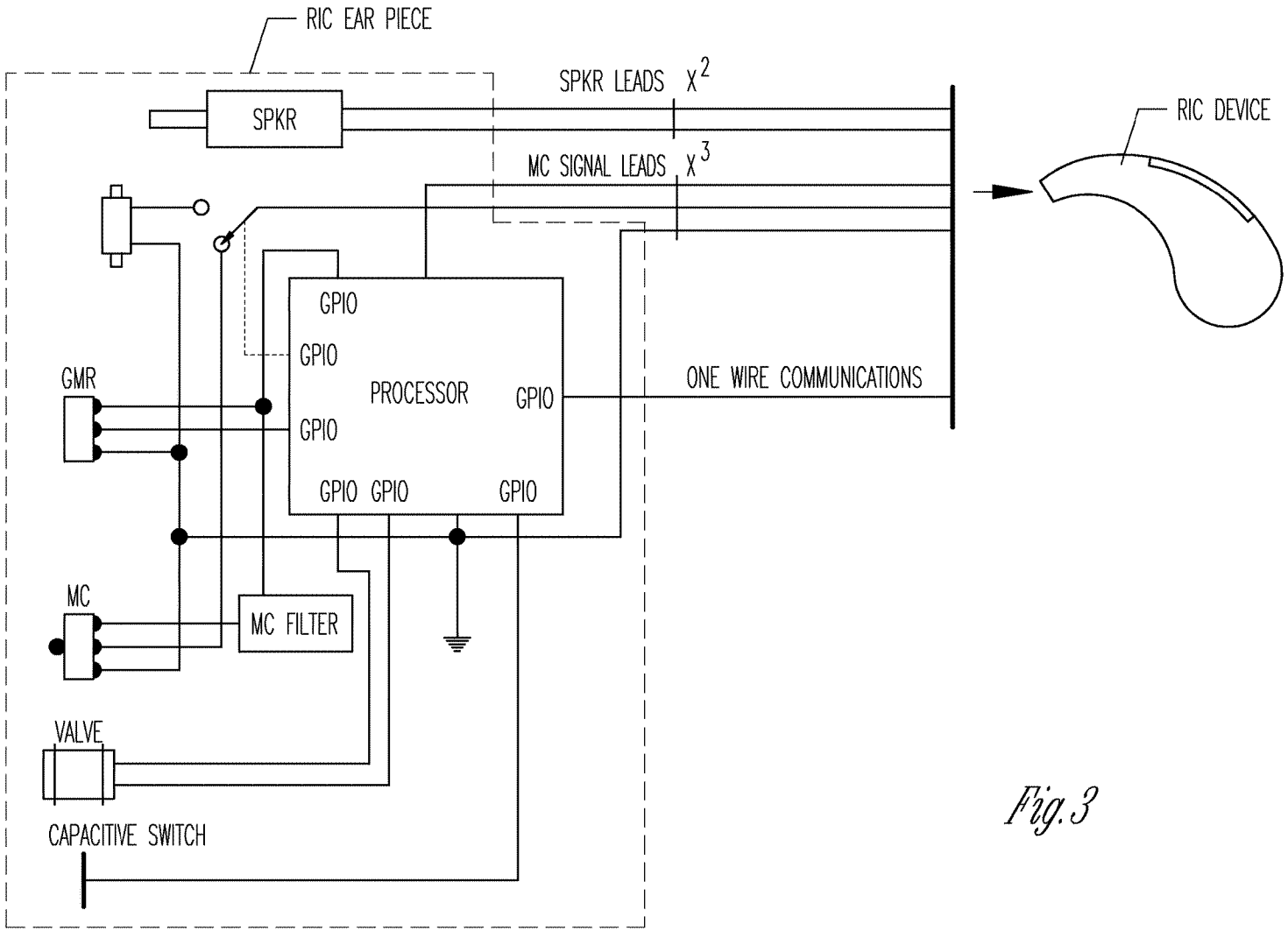
FIG. 3 illustrates a RIC hearing assistance device including a processor and microphone at the ear piece, according to various embodiments of the present subject matter.

FIG. 3 demonstrates an addition of an analog switch to select between microphone, or tele-coil signals. Also, a local filter block is shown to control microphone supply ripple that is supplied locally by a microcontroller GPIO pin. In addition, a microphone, valve, and some user interface switch capability may be added if desired. The added ear piece capability is possible with only 6 control lines. This could be reduced to 5 if the power and data transfer capability of the one wire interface is utilized.

Figure 5:
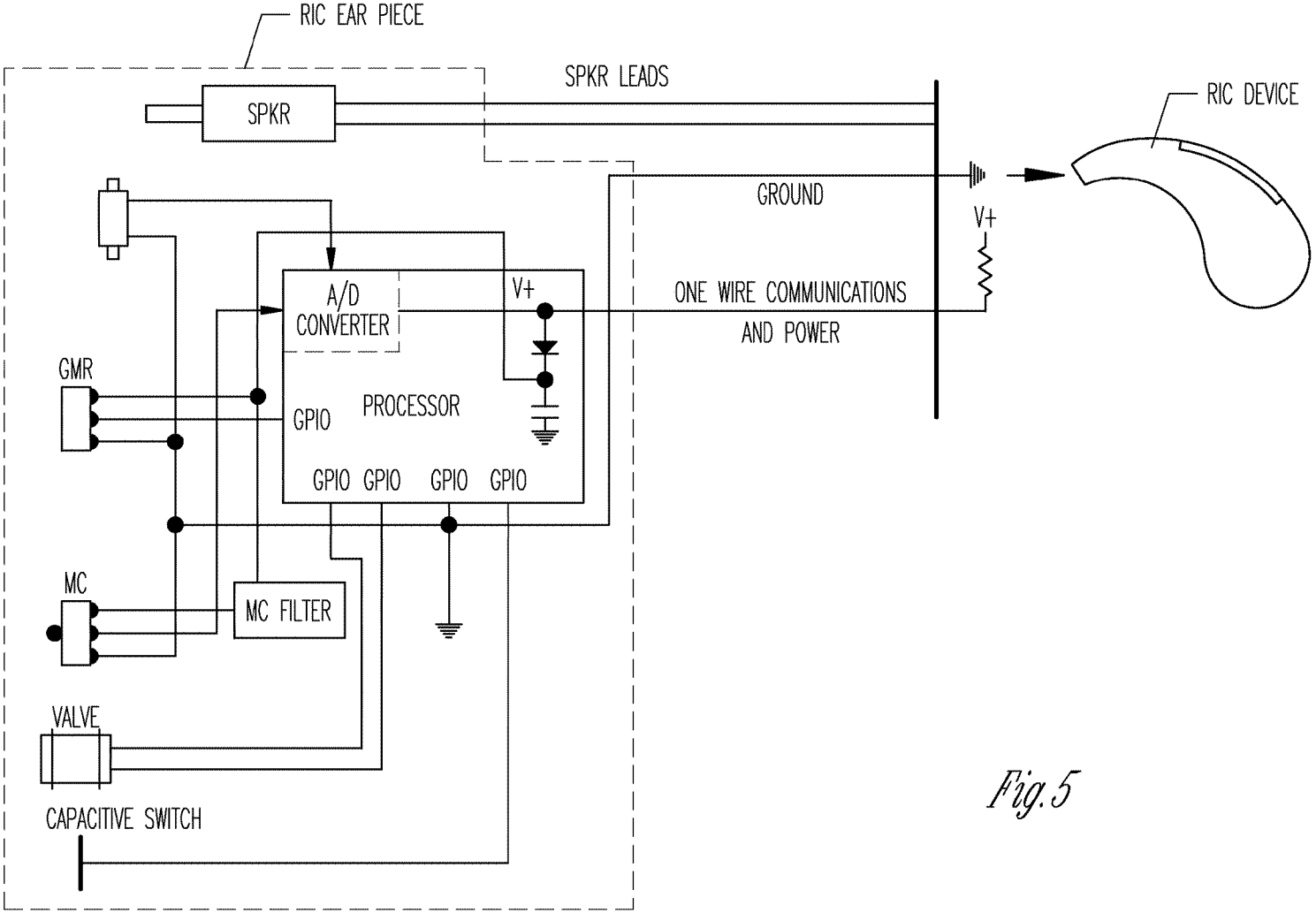
FIG. 5 illustrates a RIC hearing assistance device including a processor including an analog-to-digital (A/D) converter at the ear piece, according to various embodiments of the present subject matter.

A variant of this is illustrated in FIG. 5 in which the A/D capability of a processing component (such as a microcontroller, microprocessor, DSP, or other processor or logic) is used. Instead of transferring microphone and tele-coil signals as low level analog signals, (and that are subject to interference from speaker and external noise sources) the signals are converted into a digital data stream and transferred over the "one wire" interface. This reduces the chances of interfering noise corrupting microphone or tele-coil signals. It also reduces the number of conductors needed to transfer the signals. Also illustrated is the ability of the one wire interface to transfer power over the communications line. This also saves one or more additional conductor(s) resulting in enhanced ear piece functionality using only certain (e.g., 4 in one example) conductors for the interface shown in FIG. 5.

The processing component can be realized using a variety of hardware and firmware. For example, Maxim has a line of one-wire interface products. They can transfer up to 125 kbits/sec along with power. Power is "transferred" by using an open collector scheme where an on-board capacitor is constantly being charged when line is allowed to go high. They use an active "low" (long/short) method of transferring data. So even during communications power is being transferred. In addition, Sony has collaborated with ROHM and developed a new implementation of one wire communications that they claim has speeds of up to 450 Mbits/sec, in addition to also transferring power over same wire. The intended markets are cellular and portable electronics. These devices are apparently becoming congested with connectors and are limiting their designs. Their new protocol is designed to transfer audio and video data—more than adequate for hearing aid needs.

Additionally, the ear piece processing component can store identifying information that could let a host know how the ear piece is configured. The processing component can store what components are within ear piece, acoustic size of speaker, type of microphone, manufactured dates, assembly codes and many other types of information.

The possibility exists that some low level functions could be off loaded to this remote processor to free up valuable acoustic processing power within the host—this is in addition to the computations needed by the various components located within the ear piece which are handled by the local BTE or RIC processor that is over or on the ear.

Since embodiments employing a sound valve or other mechanically actuated devices may include relatively large power demands (i.e., to rotate the valve), a larger capacitor or super capacitor, may be used to store energy in the ear piece. In various embodiments, other power supplies may be used including, but not limited to primary cells, secondary cells, and other energy delivery apparatus.

Figure 6:
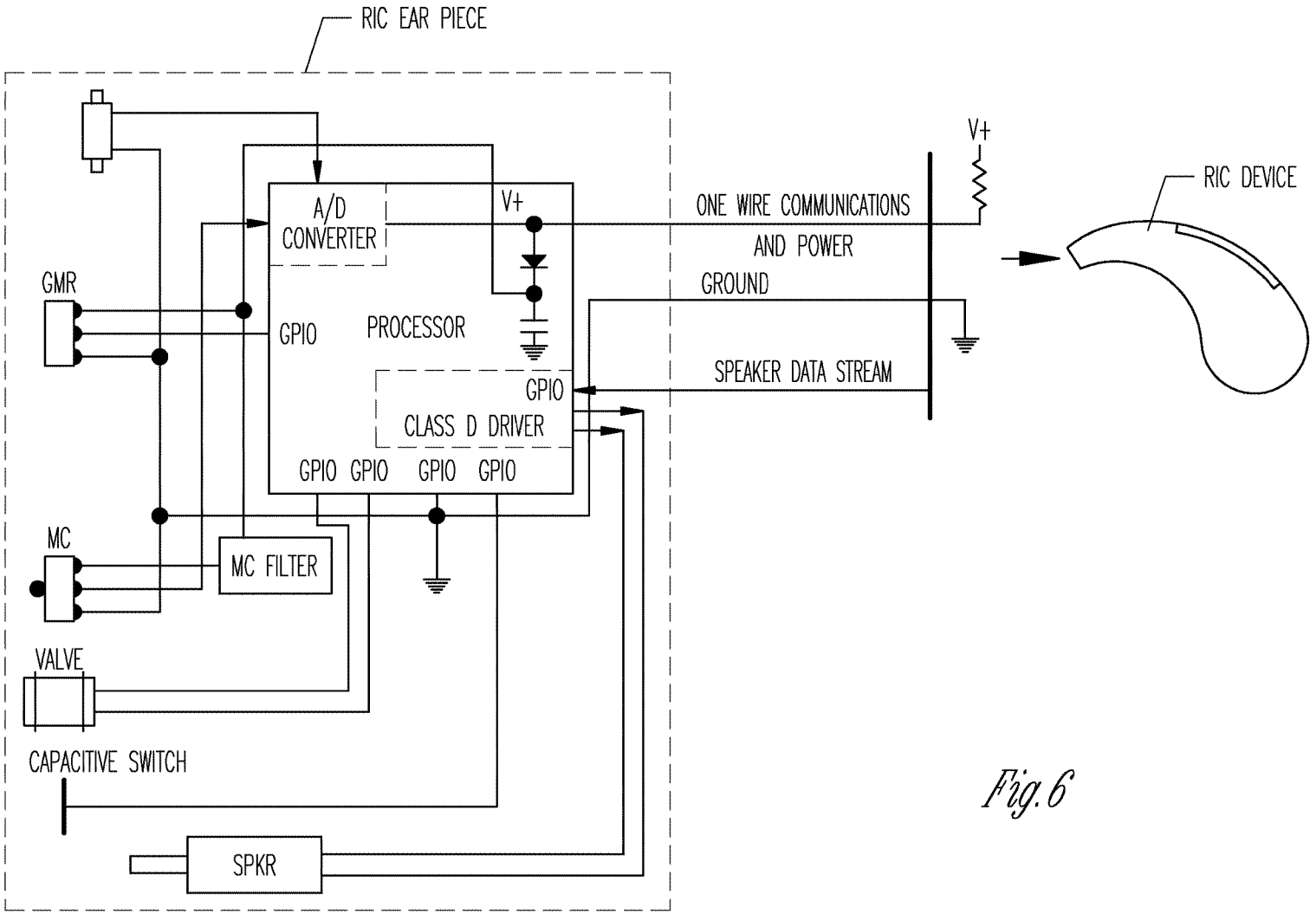
FIG. 6 illustrates a RIC hearing assistance device including a processor including an amplifier at the ear piece, according to various embodiments of the present subject matter.

In the embodiment of FIG. 6 an amplifier is added to the processing element. For example in the case where a Class D Amplifier block is added to a microcontroller, the total connector count can be decreased. In one example, three (3) lines are shown. Speaker data can be sent over a single conductor to the RIC module. The RIC located processor can take this serial data stream and convert it to a more suitable hearing aid speaker format. Several different modulation schemes can be employed, including, but not limited to pulse width modulation (PWM) and pulse density modulation (PDM). Other configurations and modulation approaches can be used without departing from the present subject matter.

One challenge with this 3 conductor and the one-wire interface in general, is how to achieve synchronization with the host. In the case of the Sony one-wire interface, the data rate for their scheme is high enough to allow for clock encoding within the data stream, without incurring audio artifacts.

Another challenge with the (3) wire scheme is ensuring that enough energy is transferred across the link so as not to "starve" the speaker. This would imply that several mW of power, as a minimum, will flow between units. Large capacitors or super capacitors could be used to store energy, allowing ear piece unit to provide seamless audio. Primary or secondary cells may be used. A $4^{th}$ conductor could be added to supply power. Other power supply options are possible without departing from the scope of the present subject matter.

One implementation of the processing component (e.g., a microcontroller (uC)) is a custom designed device that is optimized for power, size and functionality. There are numerous commercial processors/controllers available that may be suitable for this application. But, for enhanced audio performance, especially when considering the 3 wire implementation, a custom device may be used. In some embodiments, a (2 mm×2 mm) to (3 mm×3 mm) die/package will accommodate the necessary functionality.

Two important reasons for customizing the microcontroller/processor include, but are not limited to: (1) The speaker modulation in some cases is an optimized variant of standard modulations such as PDM, PPM or PWM. In some embodiments a modified variant of PDM can be used to reduce or remove speaker signal artifacts that would be present with standard PDM; and (2) for one wire communication/power links there might be more options on the firmware used since there are at least two one-wire hardware protocols to leverage.

In various embodiments, the realized system can perform one or more of the following functions including, but not limited to the following: store ear piece ID info, offload low level processing to ear piece processing component (e.g., such as switch detection/action, GMR detection/action); employ digitization of one or more of microphone, telecoil, or other signals at the ear piece to (among other things) lower interference issues associated with low level signals; send speaker signals to the ear piece using a single conductor; and/or eliminate cross-talk interference issues related to RIC/BTE devices, among other things.

The present subject matter can be used for a variety of hearing assistance devices, including but not limited to, cochlear implant type hearing devices, hearing aids, such as devices that reside substantially behind the ear or over the ear. Such devices may include behind the ear hearing aids (BTE) and hearing aids with receivers associated with the electronics portion of the behind-the-ear device, or hearing aids of the type having receivers in the ear canal of the user. Such devices are also known as receiver-in-the-canal (RIC) or receiver-in-the-ear (RITE) hearing instruments. It is understood that other hearing assistance devices not expressly stated herein may fall within the scope of the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A hearing assistance device, comprising:

hearing assistance electronics and a power supply in a housing configured to be worn above or behind an ear of a wearer;

an ear piece configured to be worn in an ear canal of the wearer; and a digitally programmable processing component in the ear piece configured to perform functions in the ear piece including modulating an incoming data stream for a hearing assistance device speaker, and configured to communicate and coordinate processing of the incoming data stream with the hearing assistance electronics using a wired connection, the processing component including an analog-to-digital (A/D) converter and configured to receive power from the power supply via the wired connection, wherein the processing component is configured to convert microphone and telecoil signals into a digital data stream to be transferred to the hearing assistance electronics using a one wire hardware protocol, wherein the ear piece includes a giant magnetoresistive (GMR) sensor configured to be used with the processing component for switching to provide power conservation.

2. The device of claim 1, wherein the processing component includes a microcontroller.

3. The device of claim 1, wherein the processing component includes a microprocessor.

4. The device of claim 1, wherein the processing component includes a digital signal processor (DSP).

5. The device of claim 1, wherein the processing component includes a custom chip design.

6. The device of claim 1, wherein the processing component includes combinational logic.

7. The device of claim 1, wherein the ear piece includes a receiver configured to convert an electrical signal from the hearing assistance electronics to an acoustic signal.

8. The device of claim 1, wherein the processing component is configured to provide ear piece identification.

9. The device of claim 1, wherein the processing component is configured to provide component activation and deactivation for power conservation.

10. The device of claim 1, wherein the ear piece includes a microphone, a valve for controlling sound passage, and a capacitive switch.

11. The device of claim 1, wherein the ear piece includes a telecoil.

12. The device of claim 1, wherein the processing component includes an amplifier.

13. The device of claim 1, wherein the ear piece includes a capacitor configured to store energy in the ear piece.

14. The device of claim 1, wherein the hearing assistance device includes a behind-the-ear (BTE) hearing aid.

15. The device of claim 1, wherein the hearing assistance device includes a receiver-in-canal (RIC) hearing aid.

16. A method, comprising:

providing a digitally programmable processing component in an ear piece portion of a hearing aid configured to be worn in an ear canal of a wearer to perform functions in the ear piece including modulating an incoming data stream for a hearing assistance device speaker, and configured to communicate using a wired connection and coordinate processing of the incoming data stream with hearing assistance electronics in a housing configured to be worn above or behind an ear of the wearer, the processing component including an analog-to-digital (A/D) converter and configured to receive power from a power supply in the housing via the wired connection, wherein the processing component is configured to convert microphone and telecoil signals into a digital data stream to be transferred to the hearing assistance electronics using a one-wire hardware protocol, wherein the ear piece includes a giant magnetoresistive (GMR) sensor configured to be used with the processing component for switching to provide power conservation.

17. The method of claim 16, further comprising using the processing component to store ear piece identification information.

18. The method of claim 16, further comprising using the processing component to control a switch in the ear piece.

19. The method of claim 16, further comprising using the processing component to employ digitization of one or more of a microphone or a telecoil.

* * * * *